US005890585A

United States Patent [19]

Nakamura et al.

[11] Patent Number: 5,890,585

[45] Date of Patent: Apr. 6, 1999

[54] LIMIT SWITCH MOUNTING STRUCTURE FOR A LINEAR ACTUATOR

[75] Inventors: Kenichiro Nakamura, Shiga-Ken; Toshio Mitsuyama, Osaka-fu; Takashi Noguchi, Kyoto, all of Japan

[73] Assignee: Tsubakimoto Chain Co., Osaka-fu, Japan

[21] Appl. No.: 818,276

[22] Filed: Mar. 18, 1997

[30] Foreign Application Priority Data

Mar. 18, 1996 [JP] Japan ..... 8-061044

[51] Int. Cl.[6] ..... H01H 3/16

[52] U.S. Cl. ..... 200/47

[58] Field of Search ..... 74/89.15, 411; 192/141, 142 R, 150; 200/33 D, 47, 573, 574, 61.13, 38 E, 61.14, 537, 538, 542; 310/13, 23; 312/201; 318/266, 369, 375, 434, 475; 361/23, 51

[56] References Cited

U.S. PATENT DOCUMENTS

| | | | |
|---|---|---|---|
| 3,192,349 | 6/1965 | Horberg, Jr. | 200/153 |
| 3,369,087 | 2/1968 | Eller | 200/47 |
| 4,137,432 | 1/1979 | Kamm | 200/47 |
| 4,307,799 | 12/1981 | Zouzoulas | 192/150 |
| 4,727,762 | 3/1988 | Hayashi | 74/89 |
| 4,763,219 | 8/1988 | Nakamura | 361/23 |
| 4,889,002 | 12/1989 | Abraham | 74/89.15 |
| 4,910,419 | 3/1990 | Hayashi | 310/13 |
| 5,579,899 | 12/1996 | Arnold | 200/47 |
| 5,620,078 | 4/1997 | Nakamura et al. | 192/142 R |
| 5,673,019 | 9/1997 | Dantoni | 340/475 |

FOREIGN PATENT DOCUMENTS 506004 of 1992 Japan ..... F16H 25/20

*Primary Examiner*—Michael A. Friedhofer
*Attorney, Agent, or Firm*—Dann, Dorfman, Herrell and Skillman; Henry H. Skillman

[57] ABSTRACT

A linear actuator in which the number of limit switches to be mounted, as well as the mounting position and direction of limit switches, can be selected with a high degree of freedom, the limit switch mounting spacing can be made short, and a positive operation is ensured while using a small number of components. Flat limit switch mounting flanges are fixed onto an outer cylinder of a linear actuator so that their positions are adjustable in both axial and circumferential directions of the outer cylinder, and a guide rail for slidably guiding a striker is supported by and between the limit switch mounting flanges. The striker is connected with the actuator rod of the actuator by a connecting rod. With projection or retraction of the actuating rod, the striker moves and actuates limit switches attached to the associated limit switch mounting flanges.

6 Claims, 5 Drawing Sheets

LIMIT SWITCH MOUNTING STRUCTURE FOR A LINEAR ACTUATOR

FIELD OF THE INVENTION

The present invention relates to a structure for mounting limit switches to a linear actuator which limit switches operate with projection or retraction of an actuating rod.

BACKGROUND OF THE INVENTION

FIG. 4 illustrates, as an example, one known prior art structure for mounting limit switches adapted to be operated with projection or retraction of an actuating rod of a linear actuator wherein the actuating rod is provided for projection and retraction with respect to an outer cylinder. In the structure shown in FIG. 4, a striker guide rod 24 and a limit switch mounting rod 25 are supported parallel to an outer cylinder 22 and between a body bracket 21 of a linear actuator 20 and a bracket 23 fixed to the front end of the outer cylinder, sleeves 26A and 27A for mounting limit switches 26 and 27 are fixed onto the limit switch mounting rod 25 so that their positions can be adjusted, and a striker 28 for actuating the limit switches 26 and 27 is slidably mounted on the striker guide rod 24.

A connecting member 30 is provided on the front end of an actuating rod 29, and one end of a striker connecting rod 31 is supported by the connecting member 30. The striker 28 is fixed to the opposite end of the striker connecting rod 31. With projecting and retracting motions of the actuating rod 29, the striker 28 slides on the striker guide rod 24, and at a retraction limit position and a projection limit position of the actuating rod 29, the striker 28 actuates the limit switches 26 and 27.

FIG. 5 shows another example of a conventional limit switch mounting structure for a linear actuator. As shown in this figure, a connecting member 42 is secured to an actuating rod 41 of a linear actuator 40, and one end of a striker supporting rod 45 is fixed to the connecting member 42. The striker supporting rod 45 supports strikers 43 and 44 at positions near both ends. The middle portion of the striker supporting rod 45 is supported for axial sliding movement by means of a guide 48 which is formed on a limit switch mounting member 47 attached to an outer cylinder 46. With a projecting or retracting motion of the actuating rod 41, the striker supporting rod 45 moves while being guided by the guide 48, and as shown in FIG. 6, the strikers 43 and 44 actuate limit switches 49 and 50, respectively, which are mounted on both sides of the limit switch mounting member 47 where the striker supporting rod 45 passes.

In the limit switch mounting structure shown in FIG. 4, it is necessary to use a striker guide rod for slidably guiding or supporting a striker or strikers, brackets for supporting the striker guide rod, and a limit switch supporting rod for mounting thereon of limit switches. Consequently, there arises the problem that the number of components required becomes larger, thus leading to an increase of production cost.

Moreover, since the limit switches are fixed onto the limit switch mounting rod through mounting sleeves, it is impossible to make the limit switch mounting spacing shorter than the mounting sleeve length. Besides, since the limit switch mounting rod and the striker guide rod are supported between the body bracket of the linear actuator and the bracket fixed on the front end side of the outer cylinder, it is impossible to mount the limit switches so as to face in a desired direction on the circumference of the outer cylinder.

Further, in the limit switch mounting structure shown in FIGS. 5 and 6, since limit switches are attached side by side to guide means, the number of limit switches capable of being mounted is limited to only two. Therefore, it is impossible to perform switching operations at three or more points within the stroke range of the actuating rod. Further, at a retracted position of the actuating rod within the outer cylinder, the striker supporting rod has a large overhang on one side of the support member, so that when the actuating rod moves at high speed, the striker supporting rod oscillates and may cause malfunction of the limit switches.

SUMMARY OF THE INVENTION

Accordingly, it is an object of the present invention to provide a limit switch mounting structure for a linear actuator which can solve the above-mentioned problems of the prior art and in which the number of limit switches to be mounted, as well as the mounting position and direction of limit switches, can be chosen with a high degree of freedom, and a stable operation can be ensured using a reduced number of components.

According to the present invention, in order to achieve the above-mentioned object, there is provided a limit switch mounting structure for a linear actuator in which an actuating rod is mounted for projection and retraction with respect to an outer cylinder, the said limit switch mounting structure comprising a plurality of limit switch mounting flanges having an axially flat shape and fixed onto the outer peripheral surface of the outer cylinder so as to afford adjustment of their positions in directions both circumferentially and axially of the outer cylinder; limit switches mounted on the limit switch mounting flanges; a striker connecting rod supported at one end thereof by a front end portion of the actuating rod and extending axially backward from the actuating rod, with a limit switch actuating striker being provided on the opposite end of the striker connecting rod; and a guide rail for guiding and supporting the striker slidably in the moving directions of the actuating rod, the guide rail being supported between at least two limit switch mounting flanges so as to be adjustable as to its longitudinal position.

Preferably, the striker is slidable in a channel-like guide rail having a longitudinal open slot, and the limit switches are actuated through the said slot with movement of the actuating rod.

As the actuating rod projects or retracts with respect to the outer cylinder, the striker, which is connected to the actuating rod through the striker connecting rod, moves along the guide rail. When the striker reaches the position of one limit switch mounting flange, it actuates the limit switch mounted to the flange and causes a predetermined signal to be generated. The operating position of each limit switch can be changed by adjusting the fixed position of the associated limit switch mounting flange axially of the outer cylinder. Further, the guide rail supporting position about the outer cylinder can be changed freely by adjusting the fixed positions of the limit switch mounting flanges circumferentially of the outer cylinder.

BRIEF DESCRIPTION OF THE DRAWINGS

All of the objects of the present invention are more fully set forth hereinafter with reference to the accompanying drawings, wherein.

DETAILED DESCRIPTION OF THE PREFERRED EMBODIMENT

Figure 1:
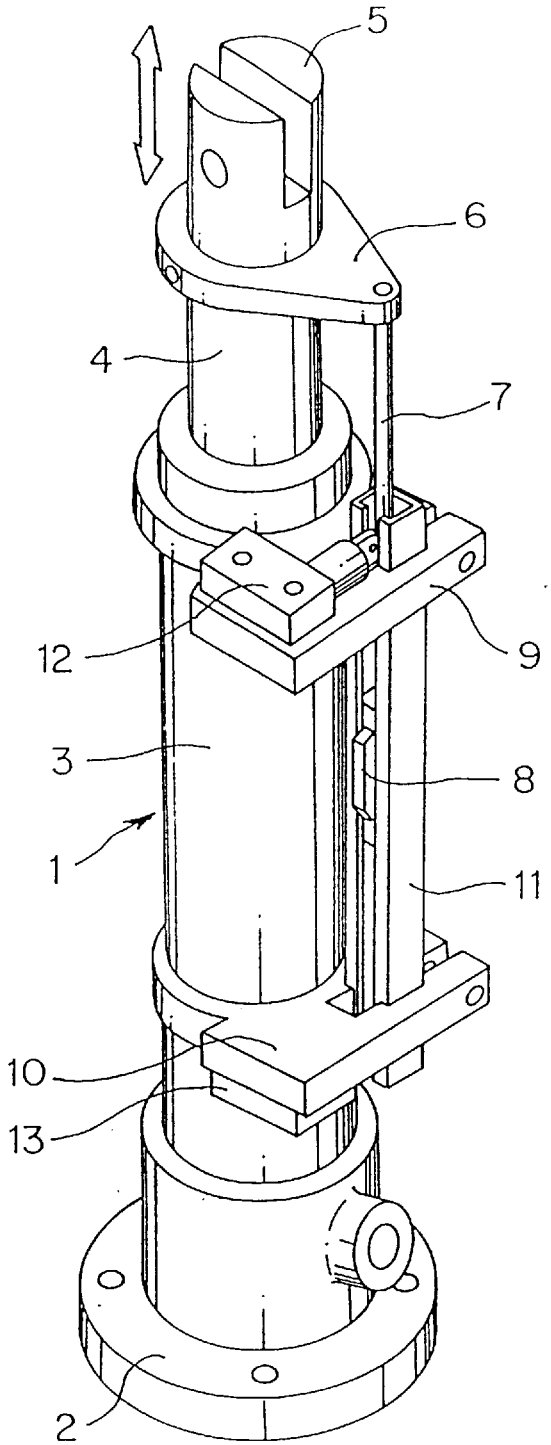
FIG. 1 is a perspective view of a limit switch mounting structure for a linear actuator according to an embodiment the present invention.

An embodiment of the present invention will now be described with reference to the drawings. FIG. 1 is a perspective view of a linear actuator equipped with a limit switch mounting structure embodying the present invention. In a linear actuator 1, an actuating rod 4 is inserted for retraction within and projection from an outer cylinder 3 which has a fixed flange 2 on its base end side. At the front end of the actuating rod 4, there is provided a tip member 5 which may be connected to a moving part of a mechanical device (not shown) which is to be driven by the actuating rod.

On the front end of the actuating rod 4 is fixed a connecting member 6 behind and adjacent the tip member 5. The connecting member 6 extends laterally outward of the actuating rod 4, and to the overhanging end thereof and is connected to one end of a striker connecting rod 7 which extends axially backward allowing the actuating rod 4. At the opposite end of the striker connecting rod 7 is provided a block-like striker 8. The striker 8 is guided and supported slidably by a guide rail 11 which is supported between a pair of limit switch mounting flanges 9 and 10, the flanges 9 and 10 being fixed to the outer peripheral surface of the outer cylinder 3 and having an axially flat shape.

Figure 2:
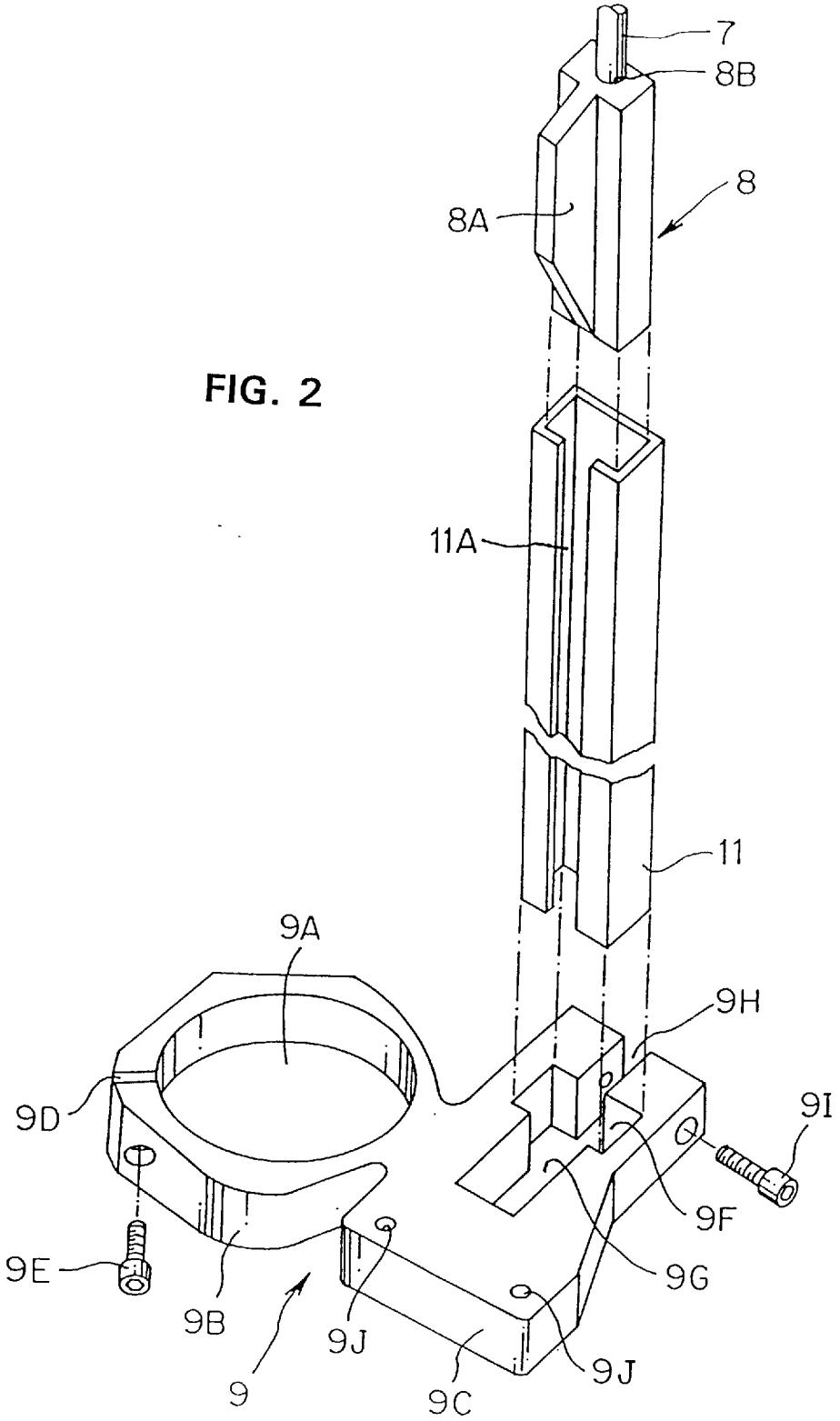
FIG. 2 is an exploded perspective view showing a principal portion of the limit switch mounting structure.

Limit switches 12 and 13, which are actuated by the striker 8, are attached to the limit switch mounting flanges 9 and 10, respectively. In this embodiment, a projection limit position of the actuating rod relative to the outer cylinder 3 is detected by the limit switch 12 positioned at the front end, while a retraction limit position of the actuating rod is detected by the limit switch 13 located on the base side of the flange 10. As shown in FIG. 2, the limit switch mounting flange 9 comprises a mounting portion 9B and a guide rail supporting portion 9C both formed integrally and adjacent each other. A through hole 9A for insertion therethrough of the outer cylinder 3 and for holding the outer peripheral surface of the outer cylinder in the mounting portion 9B, with a slit 9D is formed in part of the hole 9A. Further, a flange clamping bolt 9E is provided across the slit 9D, and as the bolt 9E is tightened, the gap of the slit 9D becomes narrower to fix the limit switch mounting flange 9 in a desired position on the outer peripheral surface of the outer cylinder 3.

In the guide rail supporting portion 9C, a guide rail supporting hole 9F of a shape conforming to the cross-sectional shape of the guide rail 11 is formed contiguous to a striker passing hole 9G of a shape which permits passing therethrough of the striker 8 while being guided by the guide rail 11. A slit 9H is formed between the inner surface of the guide rail supporting hole 9F opposite to the striker passing hole 9G and an outer face of the guide rail supporting portion 9C, and a guide rail clamping bolt 9I is provided across the slit 9H. As the bolt 9I is tightened, the gap of the slit 9H becomes narrower, whereby the guide rail 11 can be fixed to the guide rail supporting portion 9C at a desired longitudinal position. In the guide rail supporting portion 9C are formed two limit switch mounting holes 9J for mounting the limit switch 12 or 13. Though not shown in FIG. 2, the limit switch mounting flange 10 shown in FIG. 1 has the same structure as that of the limit switch mounting flange 9 with the exception that the limit switch 13 is fixed to the front of the flange 10 opposite to where the limit switch 12 is fixed.

The guide rail 11 is a hollow channel shape having a longitudinal open slot 11A and the inner surfaces thereof function to slidably guide and support the striker 8. The striker 8 is formed with a switch actuating portion 8A for actuating the limit switches 12 and 13, the switch actuating portion 8A being exposed to the exterior from the slot 11A of the guide rail 11. As shown in FIG. 1, the guide rail 11 is supported by the limit switch mounting flanges 9 and 10 so that the slot 11A faces the limit switches 12 and 13 which are attached to the flanges 9 and 10, respectively. The striker 8 is further formed with a mounting through hole 8B in its moving direction, with an end portion of the striker connecting rod 7 being inserted and fixed into the mounting hole 8B.

In the above construction, as the actuating rod 4 of the linear actuator 1 moves in its projecting direction, the striker 8, which is connected to the actuating rod 4 through both connecting member 6 and striker connecting rod 7, slides within the guide rail 11. When the actuating rod reaches its projection limit position, the switch actuating portion 8A, which is exposed exteriorly of the slot 11A of the guide rail 11, actuates the limit switch 12 to turn off an actuating rod driving motor (not shown). On the other hand, when the actuating rod 4 moves in its retracting direction and reaches the retraction limit position thereof, the switch actuating portion 8A of the striker actuates the limit switch 13 to turn off the said actuating rod driving motor. The projection limit position of the actuating rod 4 may be adjusted by loosening the flange clamping bolt 9E shown in FIG. 2, then moving the limit switch mounting flange 9 up to a desired position axially of the outer cylinder 3, then determining the position of the flange 9 in the circumferential direction of the outer cylinder 3, and again tightening and fixing the flange clamping bolt 9E. The retraction limit position of the actuating rod 4 is established by moving the limit switch mounting flange 10 up to a desired position and fixing it to the outer cylinder 3 in the same way as above. Where the mounting positions of the limit switch mounting flanges 9 and 10 are to be adjusted, at least one of the guide rail clamping bolt 9I of the flange 9 or a similar guide rail clamping bolt of the flange 10 is loosened.

Figure 3:
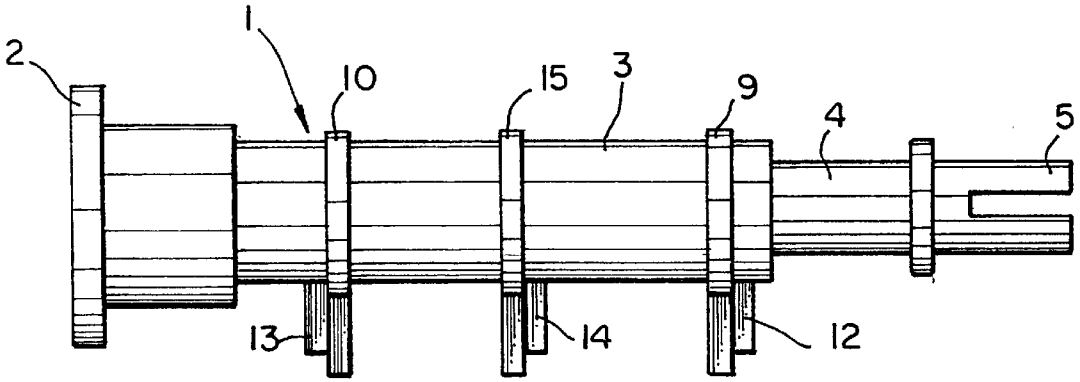
FIG. 3 is a top view of the limit switch mounting structure of FIG. 1, with an additional switch mounted at a position intermediate the projection and retraction limit positions.
Figure 4:
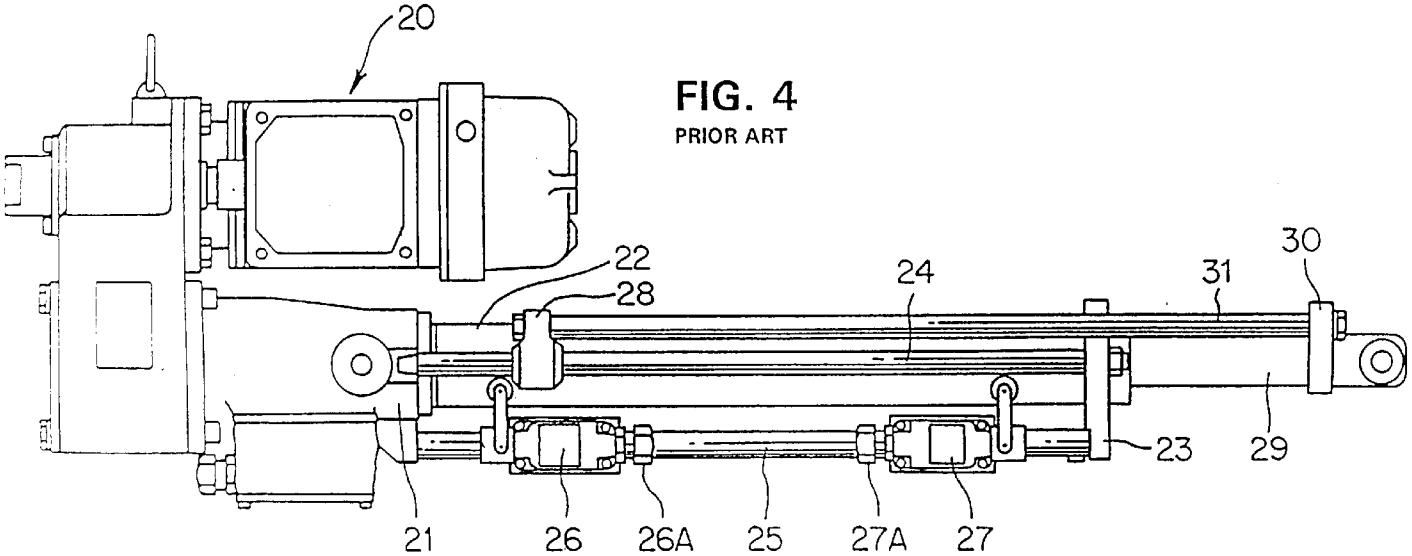
FIG. 4 PRIOR ART
FIG. 4 is a side view showing an example of a conventional prior art limit switch mounting structure for a linear actuator.
Figure 5:
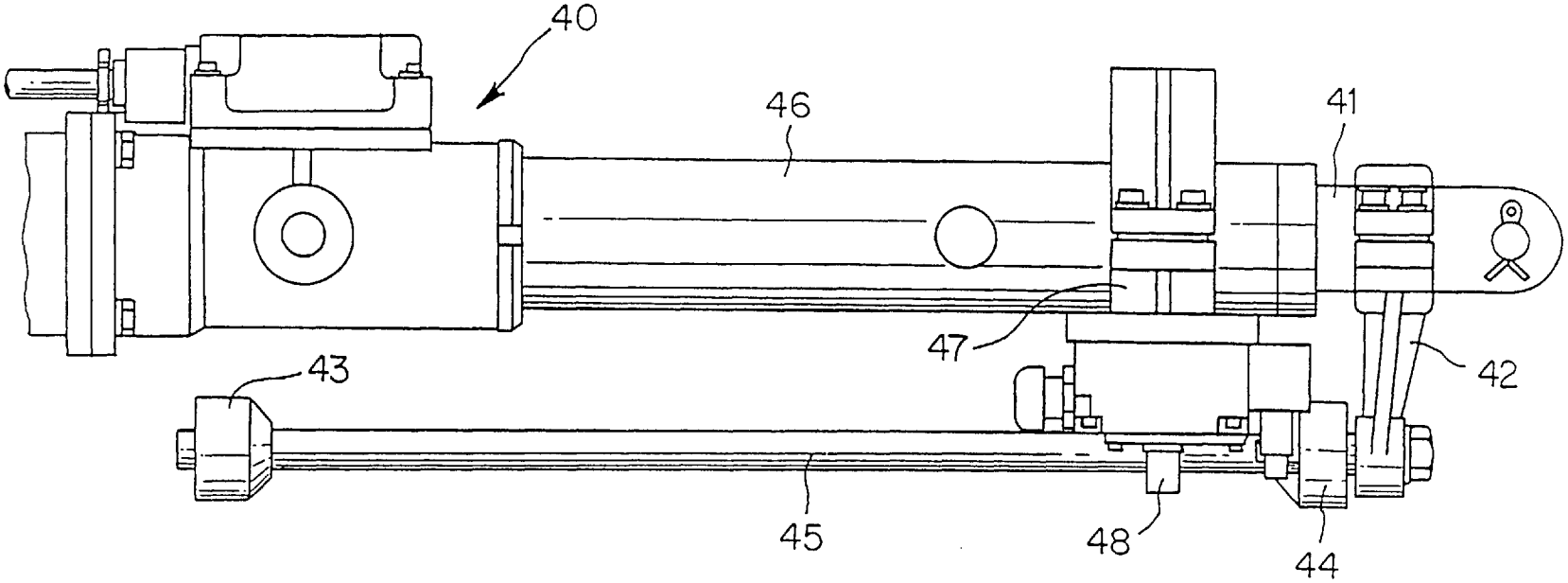
FIG. 5 PRIOR ART
FIG. 5 is a side view showing another example of a conventional limit switch mounting structure for a linear actuator.
Figure 6:
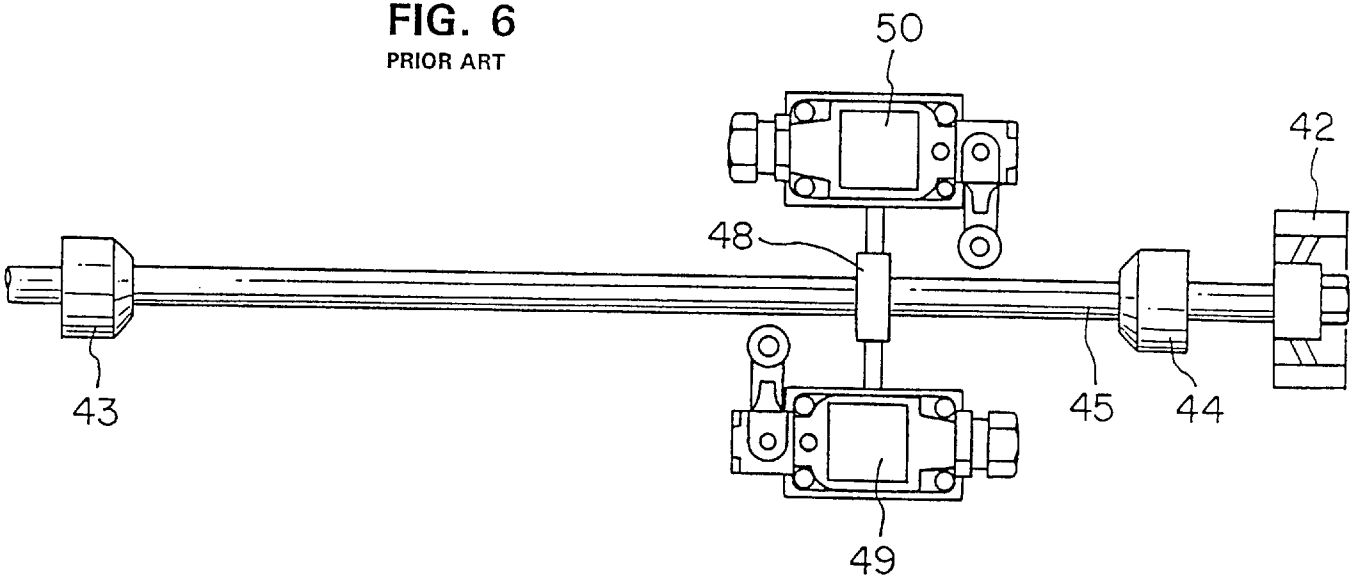
FIG. 6 PRIOR ART
FIG. 6 is a diagrammatic view showing a positional relation between strikers and limit switches in the limit switch mounting structure illustrated in FIG. 5.

Although in the above embodiment two limit switch mounting flanges with limit switches attached thereto are mounted to the outer cylinder of the linear actuator and the actuating rod is stopped by the limit switches at both projection limit position and retraction limit position of the same rod, there may be adopted a modification as shown in FIG. 3 in which the number of limit switch mounting flanges is increased to provide a flange 15 to mount a limit switch 14 at an intermediate position in the operating stroke of the actuating rod. The switch 14 affords controlling the operation of another mechanical device in interlock with the projecting and retracting motion of the actuating rod in the linear actuator. The role of the limit switches is not limited to the actuating rod stopping control. It is sufficient for the guide rail to be fixed to prevent its longitudinal movement by at least one limit switch mounting flange while the linear actuator is in use.

Although the guide rail is formed in a channel shape having a longitudinal open slot and the striker slides through the interior of the guide rail, no limitation is placed on this structure. For example, there may be adopted a structure in which the striker slides in a sandwiching relation to the guide rail.

Although in the above embodiment reference has been made to a typical conventional linear actuator wherein the actuating rod projects and retracts linearly with respect to the outer cylinder, the limit switch mounting structure according to the present invention is also applicable to a linear actuator of the type in which an actuating rod not only performs projecting and retracting motions but also rotates about its axis by a predetermined angle. In this case, a guide rail and a striker connecting rod are bent spirally along a path in which the connecting member and the striker connecting rod passes with projection and retraction of an actuating rod. Limit switch mounting flanges which support the guide rail are mounted so that their mounting angles are circumferentially displaced from each other relative to the outer cylinder in corresponding relation to the guide rail passing positions. It is necessary to use a striker of a shape conforming to the inner surface of the bent guide rail so that the striker can slide freely through the interior of the bent guide rail.

In the limit switch mounting structure for a linear actuator according to the present invention, the limit switch mounting flanges which have an axially flat shape and which support both the limit switches and the striker guiding rail are fixed to the outer peripheral surface of the outer cylinder in the linear actuator so as to be adjustable their positions in both circumferential and axial directions of the outer cylinder. It is therefore possible to set operating positions of the limit switches freely within the operating stroke of the actuating rod. Besides, the limit switches can each be mounted in a desired mounting position circumferentially about the outer cylinder.

Moreover, the mounting spacing between limit switches adjacent each other axially of the outer cylinder can be set short, and it is easy to reduce or increase the number of limit switches by merely detaching or attaching one or more limit switch mounting flanges from or to the outer cylinder. Further, since the striker is slidably guided and supported by the guide rail over the whole stroke range of the actuating rod in the linear actuator, it is possible to actuate the limit switches positively without fail and hence possible to enhance reliability of the linear actuator. Additionally, since the number of components required is smaller than that in the conventional limit switch mounting structure for a linear actuator, it is possible to attain the reduction of cost.

In the case where the striker is slidably fitted in a channel-like guide rail having a longitudinal open slot and limit switches are actuated through the said slot with movement of the actuating rod, not only the guide rail can be reduced in weight but also the rigidity thereof can be enhanced.

While a particular embodiment of the invention has been herein illustrated and described, it is not intended to limit the invention to such disclosures, but changes and modifications may be made therein and thereto within the scope of the following claims.

We claim:

1. A limit switch mounting structure for a linear actuator in which an actuating rod is mounted for projection and retraction within an outer cylinder having an outer peripheral surface, said actuating rod having a portion projecting from said cylinder, said limit switch mounting structure comprising:

a plurality of limit switch mounting flanges fixed onto said outer peripheral surface of said outer cylinder so that the positions of said plurality of flanges are adjustable in both circumferential and axial directions of the outer cylinder, said flanges having an axially flat shape;

limit switches mounted to said limit switch mounting flanges;

a striker connecting rod supported at one end of the striker connecting rod by said projecting portion of said actuating rod, said striker connecting rod extending axially of the actuating rod and terminating at an opposite end of said striker connecting rod;

a limit switch actuating striker being provided on the opposite end of said striker connecting rod; and a guide rail for slidably guiding and supporting said striker for movement in the directions of said protection and retraction of the actuating rod, said guide rail being supported between at least two of said limit switch mounting flanges so as to be adjustable in its position axially of the outer cylinder, said guide rail being fixed by at least one of the limit switch mounting flanges between which said guide rail is supported.

2. A limit switch mounting structure for a linear actuator according to claim 1, wherein said guide rail comprises a channel-like rail slidably receiving said striker and having a longitudinal open slot, said limit switches being positioned to be actuated by said striker through said slot upon movement of said actuating rod.

3. A limit switch mounting structure for a linear actuator having a cylinder and an actuating rod mounted in said cylinder, the rod having a front portion for projection and retraction axially of said cylinder, and a rear portion within said cylinder, said limit switch mounting structure comprising:

a plurality of limit switch mounting flanges mounted on said cylinder so as to be adjustable in position in both circumferential and axial directions of the cylinder, each of said flanges constructed and arranged to mount a limit switch;

a limit switch actuating striker supported by the front portion of said actuating rod and spaced rearwardly axially thereof, said striker mounted to move in a path extending generally axially of said cylinder with said projection and retraction of said actuating rod; and a guide rail extending parallel to said path of striker movement for guiding and slidably supporting said striker during movement of the actuating rod, said guide rail being supported by at least two of said plurality of limit switch mounting flanges so as to be adjustable longitudinally of said cylinder, said guide rail being fixed by at least one of the limit switch mounting flanges which support said guide rail, so as to position said striker in registry with each of said limit switches at a selected point in said path of the striker.

4. A limit switch mounting structure according to claim 3, said actuating rod being mounted for movement between fully retracted and fully extended conditions, said path having inner and outer limits corresponding respectively to the fully retracted and the fully projected conditions of said actuator rod, wherein a first of said limit switches is positioned in registry with said striker at the outer limit of said path, and a second of said limit switches is positioned in registry with said striker at the inner limit of said path.

5. A limit switch mounting structure according to claim 4, wherein a third of said plurality of limit switches is positioned in registry with said striker at a position in said path intermediate said inner and outer limits of the path.

6. A limit switch mounting structure according to claim 3 wherein said guide rail comprises a hollow channel member having a length parallel to said cylinder and an open slot extending along said length, said striker having a block-like body slidable longitudinally within said hollow channel member, and a switch actuating portion projecting through said open slot to define said path of movement of said striker, said actuating portion being constructed and arranged to operate the limit switches mounted on said flanges.

* * * * *